United States Patent [19]

Beaufrere

[11] 4,407,205

[45] Oct. 4, 1983

[54] REGENERATIVELY COOLED COAL COMBUSTOR/GASIFIER WITH INTEGRAL DRY ASH REMOVAL

[75] Inventor: Albert H. Beaufrere, Huntington,

[73] Assignee: The United States of America as represented by the U.S. Department of Energy, Washington, D.C.

[21] Appl. No.: 373,582

[22] Filed: Apr. 30, 1982

[51] Int. Cl.[3] ..... F23D 1/02

[52] U.S. Cl. ..... 110/264; 60/39.46 S; 110/347

[58] Field of Search ..... 110/263, 264, 347; 431/352; 60/39.46 S

[56] References Cited

U.S. PATENT DOCUMENTS

| | | | |
|---|---|---|---|
| 2,651,176 | 9/1953 | Yellott . | |
| 2,652,792 | 9/1953 | Yellott . | |
| 2,770,947 | 11/1956 | Ledinegg . | |
| 2,800,091 | 7/1957 | Lotz et al. | 110/264 |
| 2,861,423 | 11/1958 | Jerie et al. . | |
| 2,888,804 | 6/1959 | Yellott et al. . | |
| 2,911,065 | 11/1959 | Yellott et al. . | |
| 2,954,097 | 9/1960 | Yellott et al. . | |
| 3,408,812 | 11/1968 | Stenger . | |
| 3,589,128 | 6/1971 | Sweet . | |
| 3,702,058 | 11/1972 | DeCorso et al. . | |
| 3,706,203 | 12/1972 | Goldberg et al. . | |
| 3,911,277 | 10/1975 | Cederstrand et al. . | |
| 4,109,459 | 8/1978 | Ekstedt et al. . | |
| 4,204,836 | 5/1980 | Nowak et al. | 110/264 X |
| 4,244,179 | 1/1981 | Kainov et al. . | |
| 4,262,487 | 4/1981 | Glenn . | |

*Primary Examiner*—Edward G. Favors

*Attorney, Agent, or Firm*—Robert H. Whisker; Paul A. Gottlieb; Richard G. Besha

[57] ABSTRACT

A coal combustor/gasifier is disclosed which produces a low or medium combustion gas for further combustion in modified oil or gas fired furnaces or boilers. Two concentric shells define a combustion volume within the inner shell and a plenum between them through which combustion air flows to provide regenerative cooling of the inner shell for dry ash operation. A fuel flow and a combustion air flow having opposed swirls are mixed and burned in a mixing-combustion portion of the combustion volume and the ash laden combustion products flow with a residual swirl into an ash separation region. The ash is cooled below the fusion temperature and is moved to the wall by centrifugal force where it is entrained in the cool wall boundary layer. The boundary layer is stabilized against ash re-entrainment as it is moved to an ash removal annulus by a flow of air from the plenum through slots in the inner shell, and by suction on an ash removal skimmer slot.

10 Claims, 3 Drawing Figures

Clean Combustion Gas Out
Air In
Fuel In
Flue Gas or Steam In

REGENERATIVELY COOLED COAL COMBUSTOR/GASIFIER WITH INTEGRAL DRY ASH REMOVAL

The United States Government has rights in this invention pursuant to Contract Number DE-AC02-76CH00016, between the United States Department of Energy and Associated Universities, Inc.

BACKGROUND OF THE INVENTION

This invention relates to the combustion of coal and particularly to an apparatus suitable for the partial combustion, or gasification, of coal, hereinafter referred to as a "combustor/gasifier".

With the growing concern about the availability of oil and natural gas supplies, increasing attention has been paid to the use of coal, and particularly to the use of coal in retrofit application where coal is substituted for oil or gas as a fuel in existing facilities. An attractive technology for such retrofit applications is the two-stage combustion of coal. In the first stage, external to a conventional boiler or furnace, coal is partially combusted in a fuel rich environment to produce a hot combustible gas. In the second stage, this gas is fully combusted. Since this second stage combustion may be easily carried out in the fireboxes of existing oil or gas fired facilities, the potential suitability of two-stage combustion techniques for retrofit applications is readily apparent to those skilled in the combustion art.

Large scale introduction of this technology depends on the development of a suitable first-stage combustor/-gasifier. Such a combustor/gasifier would have to meet several criteria. First, the gas produced by the combustor/gasifier must be substantially free of ash when it is introduced into the second stage. Second, loss of the sensible heat produced by the partial combustion in the combustor/gasifier should be minimized in order to achieve a high over-all combustion efficiency. Third, the first-stage partial combustion and ash removal must be carried out at high flow rates to achieve low cost and reliable close-coupling with the second stage. Further, the capital and operating costs of the combustor/-gasifier must be economical.

Previous external combustors or gasifiers have typically been of the cyclone, slagging type where a fuel stream of pulverized coal or a coal slurry and combustion air are introduced into the combustor with a swirling motion and the ash is thrown to the walls by the induced centrifical force and removed as molten ash or "slag". This swirl-mixing gives an intense, stable combustion which allows a compact structure.

Such cyclone type combustors operate at a temperature above the fusion point of the coal (i.e. at a temperature such that the ash is liquid). The liquid ash, or slag, is thrown to the walls of the combustor which are maintained at a temperature above the fusion point of the slag so that the slag remains liquid and thus may be drained off through a "slag tap".

This type of slagging operation has, however, several disadvantages. The slag causes severe corrosion problems as well as problems of slag build-up and fouling. The fouling problems are aggrevated by water in the coal which tends to cause a need for expensive coal drying facilities and to preclude the use of coal/water slurries.

A second problem is that the high temperature required at the walls for the slagging operation are dangerously near to the useful temperature limits for available cost-effective wall materials. This problem is compounded by the fact that currently economical coal cleaning techniques tend to raise the fusion point of coal ash. Further, coal with an appreciable ash content must be used since an appreciable amount of ash is needed to effectively control the wall temperature.

It is also known to use fixed or fluidized bed combustors as combustor/gasifiers. Such combustor/gasifiers generally effectively remove the ash, but have an unsatisfactory low through-put for a given size and poor reliability due to slag tap plugging.

Thus, it is an object of the subject invention to provide a cyclone-type combustor/gasifier which produces a dry ash.

It is a further object of the subject invention to provide a combustor/gasifier having integral capabilities for ash removal.

It is another object of the subject invention to provide a compact, economical, combustor/gasifier capable of close-coupled high through-put operation.

It is still another object of the subject invention to provide a combustor/gasifier having a minimal loss of sensible heat to the environment while at the same time operating at combustion temperatures low enough for dry ash operation.

BRIEF SUMMARY OF THE INVENTION

The above objects are achieved and the disadvantages of the prior art are overcome by means of a coal fired combustor/gasifier comprising an outer shell and an inner shell concentric with the outer shell. The inner shell thus defines a plenum between the shells and an inner combustion volume having a closed end and an open end. The inner shell has a plurality of circumferential, longitudinally spaced slots for directing air flow from the plenum along the inner surface of the inner shell in the direction of the open end and an additional circumferential opening adjacent to the closed end for admitting a flow of combustion air into the volume defined by the inner shell. Air inlet means are provided for introducing a flow of air into the plenum. This air flow comprises the combustion air for the combustor/-gasifier and combustion air for the second stage combustor as well as a slight excess of air used to carry off the ash produced in the combustor/gasifier. Air flowing through the plenum is regeneratively heated, thereby cooling the inner shell and preventing the loss of combustion heat to the environment. Combustion heat, which would otherwise be lost, heats the combustion air and is returned to the combustion process. Connecting means are provided adjacent to the open end of the gasifier for connecting the flow of second stage combustion air in the plenum to the second stage combustor. First swirler means are provided adjacent to the additional circumferential opening in the inner shell for introducing a swirling motion into the gasifier combustion air flow and fuel inlet means are also provided for introducing a flow of fuel into the closed end of the combustion volume. The fuel inlet means further comprises a second swirler means for introducing a swirling motion, opposite to the combustion air swirl, to the fuel flow. Skimmer means are also provided adjacent to the open end of the combustor/gasifier for the removal of ash produced in the gasifier.

In operation the combustor/gasifier is connected to the second stage combustor, which preferably will be the firebox of a conventional oil or gas fired boiler or furnace modified to burn the combustor/gasifier combustion gases, so that the open end of the combustion volume is aligned with the throat of the second stage, and so that the second stage combustion air may flow from the air inlet means, through the plenum, where it is regeneratively heated, to the second stage combustor. Fuel, and air from the plenum, are introduced at the closed end of the combustor with opposed swirls and are burned in a mixing/combustion zone adjacent to the closed end of the combustion volume. The air flow rate and temperature are controlled so that combustion is incomplete and a combustion gas having a substantial BTU value is produced, and so that the combustion temperature is not too high for satisfactory dry-ash operation. As the flow moves down the combustion volume the angular momentum of the combustion air flow overcomes the angular momentum of the fuel flow and a uniform swirling motion is established. As this happens the flow moves into an ash separation-removal zone. In this zone the operation is similar to the operation of a cyclone particle separator, but without gas reversals; the ash in the flow of combustion gas is moved to the surface of the inner shell by centrifugal force where it is entrained in the boundary layer. The air flow from the longitudinally spaced slots moves the entrained ash along the inner surface towards the skimmer means where the ash is drawn off from the gasifier and at the same time the air flow limits the re-entrainment of ash into the combustion gas stream. The combustion gas flows out the open end of the combustion volume into the throat of the second stage combustor where it is burned with the second stage combustion air which has been heated as it passed through the plenum of the first stage.

It is an important feature of the subject invention that the temperature adjacent the inner surface of the inner wall is maintained at a temperature low enough to insure fusion of the ash by the flow of both first and second stage combustion air through the plenum. This wall cooling is adjusted to allow the temperature in the mixing/combustion zone to be substantially higher than in the ash separation-removal zone in order to insure rapid, intense, but stable combustion of the fuel. The temperature of the walls in the mixing-combustion zone is kept below the ash fusion point by films of cooling air drawn from the plenum.

In a preferred embodiment of the subject invention flue gas, or steam, is introduced concentric with, and with an opposite swirl to, the fuel flow to augment the residual gas swirl from the combustion zone.

Thus, the subject invention advantageously provides a compact, high through-put coal combustor/gasifier with integrated dry ash removal.

It is another advantage of the subject invention that the loss of sensible heat to the environment is minimized through the use of both the combustor/gasifier combustion air and the second stage combustion air for regeneratively cooling the inner shell.

It is still another advantage of the subject invention that the regenerative cooling of the inner shell by both the first and second stage combustion air permits combustion to be carried out at a temperature high enough for stable combustion but low enough to insure that the ash is cooled below the fusion point before separation-removal; minimizing the problems of corrosion and fouling in the combustor/gasifier and in the second stage conbustor.

It is still another advantage of the subject invention that the combustor/gasifier walls experience temperatures substantially below that required at the walls of a slagging-type combustor/gasifier.

It is still another advantage of the subject invention that coal with a substantial moisture content or coal/-water slurriers may be used as fuel without the aggrevated slag fouling problems found when such fuels are used in slagging combustors.

It is still another advantage of the subject invention that it is less sensitive to wall and combustion temperatures than slagging type combustors, and is, therefore, less prone to fouling under varying conditions of operation.

Other objects and advantages of the subject invention will become apparent to those skilled in the art from a consideration of the drawings, and the detailed description set forth below.

DETAILED DESCRIPTION OF AN EMBODIMENT OF THE INVENTION

Figures 1, 2, 3:
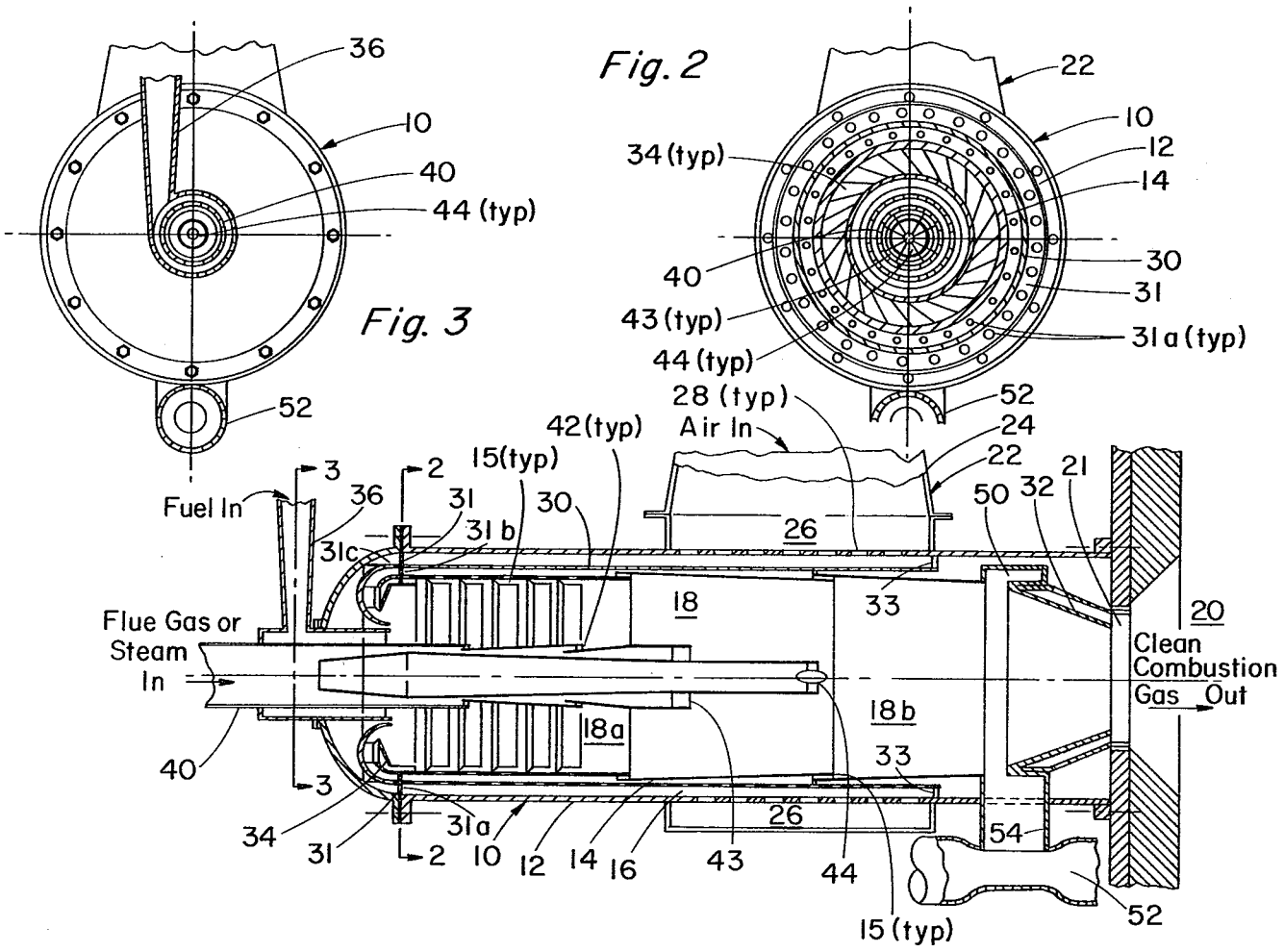
FIG. 1 is a longitudinal cross section of a combustor/gasifier in accordance with the subject invention.
FIG. 2 is a transverse cross section along line 2—2 of FIG. 1.
FIG. 3 is a transverse cross section along line 3—3 of FIG. 1.

Turning to FIGS. 1, 2 and 3 there is shown a combustor/gasifier 10 in accordance with the subject invention operatively connected to the throat of a second stage combustor 20. Typically, second stage combustor 20 will be the firebox of a conventional oil or gas fired boiler or furnace with its air injection means modified to burn the combustion gases produced by combustor/-gasifier 10. Such boilers or furnaces, and the necessary modifications, are well known in the art and no further discussion or illustration of the details of the second stage combustor is necessary for an understanding of the subject invention.

Combustor/gasifier 10 comprises a cylindrical outer shell 12, or pressure vessel, closed at one end and fastened to and aligned with second stage combustor 20 at the other. Within, and concentric with outer shell 12, is an inner shell 14, defining a plenum 16 between outer shell 12 and inner shell 14 and a combustion volume 18 which further comprises a mixing/combustion zone **18*a* adjacent to the closed end of combustion volume 18 and an ash separation-removal zone 18*b* adjacent to the open end of volume 18. Inner shell 14 is formed from ceramic or ceramic-coated metal in order to better withstand the combustion heat and the severe corrosion-erosion conditions inherent in the combustion process. Shell 14 has a thermal conductivity such that approximately 15–30% of the combustion heat flows through it to regeneratively heat the combustion air flowing through plenum 14**.

Air inlet means 22 are provided for introducing a flow of air into plenum 16. Inlet means 22 comprises ducting 24 and a secondary plenum 26 which surrounds pressure vessel 12 extending substantially over the ash separation-removal zone. Air flows from plenum 26 into plenum 16 through openings 28 in pressure vessel 12.

Some of the air flowing into plenum 16 is directed through distributor 30 against inner shell 14 to cool it, by a process commonly referred to as blast-convective cooling. The flow of air in through distributor 30 is chosen to remove about 15–30% of the heat generated in combustion volume 18 and flowing through inner shell 14. The end of distributor 30 adjacent to the closed end of combustor/gasifier 10 is supported by baffle plate 31, while the other end is supported by a conventional thermal expansion slip support 33. Baffle plate 31 also serves to control the temperature of the air which flows through plenum 16 into combustion volume 18 in a manner which will be more fully described below. Alternatively, other well known techniques to enhance heat transfer through inner shell 14, such as the addition of fins, for conventional convective cooling may be used instead of blast-convective cooling.

A portion of the heated air flow in plenum 16 then flows to second stage combustor 20, either into throat 21 or to secondary air inlet ports of combustor 20 (not shown) through second stage air inlet annulus 32, to serve as the combustion air for combustor 20. A second combustion air flow passes through radially distributed holes 31*a* and 31*b* in baffle plate 31. As will be readily apparent to those skilled in the art, the flow through baffle plate 31 comprises two parts; a cooler flow outside of distributor 30 which passes through holes 31*a*, and hotter a flow between distribution 30 and inner shell 14 which passes through holes 31*b*. After these two flows pass through baffle plate 31, a swirling motion is introduced in the flows by a swirler means comprising swirler blades 34 and the swirling flows enter mixer/combustion zone 18*a*. Radially distributed holes 31*c* are provided in swirler blades so that the hotter and colder flows may mix and an appropriate average temperature for the air flow into combustion volume 18 can be achieved by a proper choice of the sizes and distribution of holes 31*a*. The proper choice may be aproximately determined by well known techniques for computing heat and mass flows, but some routine experimentation may prove necessary to optimize the choice of sizes and distribution of holes for particular operating conditions. This control of the combustion air temperature aides in the control of the combustion temperature in combustion volume 18. (It should be noted that heat transferred through inner shell 14 is not all lost. A substantial portion is regeneratively returned to the combustion process.)

Fuel inlet means, which may comprise offset inlet pipe 36, are provided to introduce fuel into the mixing combustion zone 18*a* with a swirling motion opposed to the swirl of the combustion air. This opposed swirling action provides a rapid thorough mixing of fuel and air and intense, stable combustion.

Fuel used in the subject invention may comprise air-entrained pulverized coal or coal-water slurries and the necessary swirl may alternatively be introduced by swirler vanes, rotary fuel slingers or other conventional means. Air/fuel ratios and combustion temperatures in the mixer/combustion zone are chosen below an equivalence ratio of about 0.7 so that combustion is not complete and a combustible gas is produced for further combustion. Combustion takes place in mixer/combustion zone 18*a* at a temperature of about 2500° F. to insure stable combustion and good efficiency, while near inner shell 14 temperatures are maintained below the ash fusion point.

As the combustion products move from the mixer/-combustion zone 18*a* into the ash separation-removal zone 18*b*, a flow of swirl augmentation gas is concentrically introduced through inlet pipe 40 with a swirl in the same direction as the initial combustion air swirl to insure that sufficiently intense swirl is achieved to drive the ash to the walls where it is removed. Inlet pipe 40 is provided with a plurality of circumferential, longitudinally spaced slots 42, which allow a flow of swirl augmentation gas along the outside of inlet pipe 40, serving both to cool the outer surface of pipe 40 and to sweep ash into the ash separation-removal zone. Swirler blades 43 and 44 are fixed to the ends of inlet pipe 40 to also augment the swirl of the gas flow. The ratio of swirl velocity of flow through combustor/gasifier 10 to its longitudinal velocity should be above 1:1.

The ash separation-removal zone 18*b* functions essentially as an inertial particle separator, or straight flow-through cyclone; the clean combustion gas produced in the mixing-combustion zone flows into throat 21 while ash is moved to the walls by centrifugal force. Here the ash is entrained in the boundary layer adjacent to the inner shell 14. Here, because of the cooling of shell 14, the ash is cooled to a temperature about 1800° F. safely below the ash fushion point. The boundary layer adjacent to inner shell 14 is stabilized to prevent re-entrainment of the now solidified ash particles by a relatively small flow of air from plenum 16 through annulur slots 15. This air flow through slots 15 also aides in cooling the inner surface of shell 14 and maintains an axial flow in the boundary layer so that the ash entrained in the boundary layer is swept towards the ash collection means.

The ash collection means comprise ash collection skimmer annulus 50 connected to ash removal pipe 52. A slight suction is maintained in annulus 50 and pipes 52 by eductor 54 so that the boundary layer, and the ash entrained therein, are drawn off into annulus 50. This suction also aides in stabilizing the boundary layer and preventing re-entrainment of the ash and may also be provided by other conventional means such as pumps. It is also preferable that the height of annulus 50 increase azimuthally in the direction of the swirl in order to aide in maintaining the swirl and reduce turbulence.

After passing through the ash removal zone the now substantially ash free combustion gas produced in combustor/gasifier 10 flows into throat 21 of second stage combustor 20 for further combustion.

The above detailed description and the attached drawings are provided by way of illustration only, and various other embodiments of the subject invention will be readily apparent to those skilled in the art. Particularly those skilled in the art will recognize that the combustor/gasifier of the subject invention may readily be operated with excess air so as to completely burn the fuel and function as a combustor only. Thus, limitations on the subject invention are to be found only in the claims set forth below.

I claim:

1. A coal combustor/gasifier comprising:

(a) a pressure vessel, said pressure vessel having a closed end and an open end and being adapted to make a pressure tight connection at said open end to a second stage combustor;

(b) an inner shell, formed from a high temperature, corrosion-erosion resistant material, substantially concentric with said pressure vessel, and defining a combustion volume having a closed end, a mixing-/combustion zone adjacent to said closed end, and an ash separation-removal zone opening into the throat of said second stage combustor, and also defining with said pressure vessel a plenum through which air flows, between said pressure vessel and said inner shell, said inner shell also having;

(1) a plurality of axially spaced slots for diverting air flow from said plenum along the inner surface of said inner shell in the direction of said second stage combustor, whereby the boundary layer at said inner surface is stabilized and said inner shell is cooled; and (2) an additional opening adjacent said closed end of said volume for admitting a flow of combustion air into said volume;

(c) air inlet means for introducing a flow of air into said plenum;

(d) first swirler means adjacent said additional opening for imparting a swirling motion to said combustion air;

(e) fuel inlet means for introducing a flow of fuel into said mixing/combustion zone, said fuel inlet means further comprising second swirler means for introducing a swirling motion opposite that of said combustion air in said fuel flow, said swirling motions being such that the opposed swirls assure that said fuel and said combustion air are well mixed in said mixing/combustion zone, and such that a residual swirl tending to move ash formed in said mixing-/combustion zone to said boundary layer is established in said separation-removal zone; and (f) ash removal means adjacent said open end for withdrawing said flow of air along the inner surface and the ash entrained therein.

2. A coal combustor/gasifier as described in claim 1, wherein the flow rate of air through said plenum is sufficient to maintain said inner shell at a temperature sufficiently below the ash fusion point of the coal burned to insure dry ash operation.

3. A coal combustor/gasifier as described in claim 2 further comprising a distributor within said plenum, spaced from said pressure vessel and said shell for diverting a part of the flow of air against said inner shell so as to provide a blast-convective cooling effect.

4. A coal combustor/gasifier as described in claims 1, 2 or 3, wherein the air fuel ratio in said mixing/combustion zone and the air flow in said plenum and the temperature of the combustion air are chosen so that combustion takes place at a temperature of about 2500° F. and the combustion gas produced is suitable for second stage combustion.

5. A coal combustor/gasifier as described in claim 4, wherein a flow of swirl augmentation gas is introduced into said combustion volume concentric with, and having a swirl opposite to, said fuel flow, whereby said residual swirl is enhanced.

6. A coal combustor/gasifier as described in claim 4, wherein the ratio of the swirl velocity of flow through the gasifier to its longitudinal velocity is above 1:1.

7. A coal combustor/gasifier as described in claim 3, wherein the temperature of the combustion air into said volume is controlled by mixing preselected portions of the part of the air flow in said plenum which has been diverted against said inner shell for cooling, and the air flow within said plenum which has not been so diverted.

8. A coal combustor comprising a coal combustor/-gasifier as described in claim 4, operatively connected to a second stage combustor so that the combustion air for said second stage flows through said plenum, whereby the heat transferred through said inner shell is regeneratively returned to the second stage combustion process.

9. A coal combustor comprising a coal combustor/-gasifier as described in claim 5, operatively connected to a second stage combustor so that the combustion air for said second stage flows through said plenum, whereby the heat transferred through said inner shell is regeneratively returned to the second stage combustion process.

10. A coal combustor comprising a coal combustor/-gasifier as described in claim 6, operatively connected to a second stage combustor so that the combustion air for said second stage flows through said plenum, whereby the heat transferred through said inner shell is regeneratively returned to the second stage combustion process.

* * * * *